United States Patent [19]

Niemczyk

[11] 4,121,416

[45] Oct. 24, 1978

[54] MINIATURE GRANDFATHER CLOCK

[76] Inventor: Chester Niemczyk, 3508 W. 79th St., Chicago, Ill. 60652

[21] Appl. No.: 825,233

[22] Filed: Aug. 17, 1977

[51] Int. Cl.[2] ..... G04B 31/14

[52] U.S. Cl. ..... 58/88 R; 58/53; 58/123; 58/129; 206/301; 206/457; 310/39; D10/128

[58] Field of Search ..... D9/195, 201, 225, 229; D10/128; 58/53, 54, 55, 56, 88 R, 88 E, 88 G, 123, 129; 310/32, 39; 206/223, 18, 301, 45.31, 457, 549, 566

[56] References Cited

U.S. PATENT DOCUMENTS

| | | | |
|---|---|---|---|
| D. 129,896 | 10/1941 | Cohen | D10/128 |
| 2,810,083 | 10/1957 | Dunay | 310/32 |
| 2,833,943 | 5/1958 | Anthony | 310/32 |
| 3,128,398 | 4/1964 | Ito | 310/32 |
| 3,418,502 | 12/1968 | Dunay | 310/32 |
| 3,546,874 | 12/1970 | Botty et al. | 58/129 |
| 3,762,154 | 10/1973 | Petrides | 58/129 |
| 3,853,216 | 12/1974 | Jaeschke | 206/301 |
| 3,924,401 | 12/1975 | Heim | 58/129 |
| 4,006,586 | 2/1977 | Casella | 206/577 |
| 4,043,118 | 8/1977 | Haag et al. | 58/53 |

*Primary Examiner*—William Price
*Assistant Examiner*—Bruce H. Bernstein
*Attorney, Agent, or Firm*—Robert D. Farkas

[57] ABSTRACT

A simulated clock apparatus utilizes a housing having an opening therein and a shelf disposed in the housing below the opening. A conventional wristwatch is adapted to be rested on the shelf so as to have the face of the clock exposed for external viewing through the opening. A pendulum is pivotably secured to the shelf and is displayed visibly through a second opening located below the opening. The pendulum may be continuously oscillated back and forth in conventional "Grandfather Clock" fashion by a bar passing through a solenoid coil, such that the bar is urged into oscillatory motion, when contacting an electrical switch at an end thereof such that the switch is operated into a closed position causing a current flow from the battery, housed within the housing, to exert a pulling force on a ferromagnetic portion of the center of the bar. When the bar moves away from its displaced non centric position towards a rest position, the switch is opened causing the current flow to cease such that the momentum of the bar causes an override and continued oscillation until the next cycle wherein the switch again is urged into a closed position by contacting the end of the bar. The pendulum, by moving back and forth, creates a miniature effect of a "Grandfather Clock," coupled with the actual operating of the wrist-watch hand. The wrist-watch may be secured into the storage position within the housing utilizing a block of foam rubber-like material.

5 Claims, 4 Drawing Figures

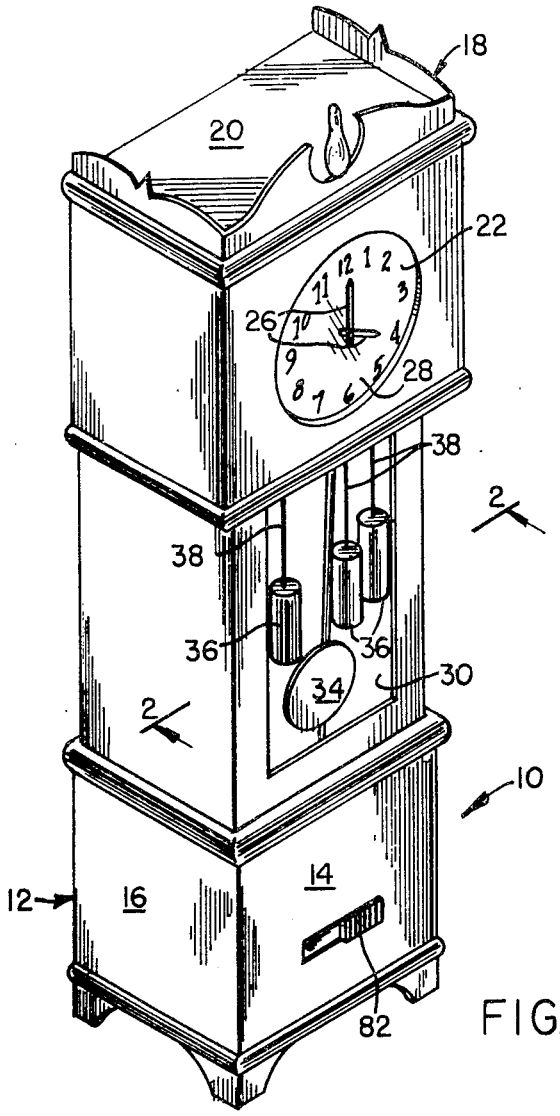
FIG. 1
FIG. 2
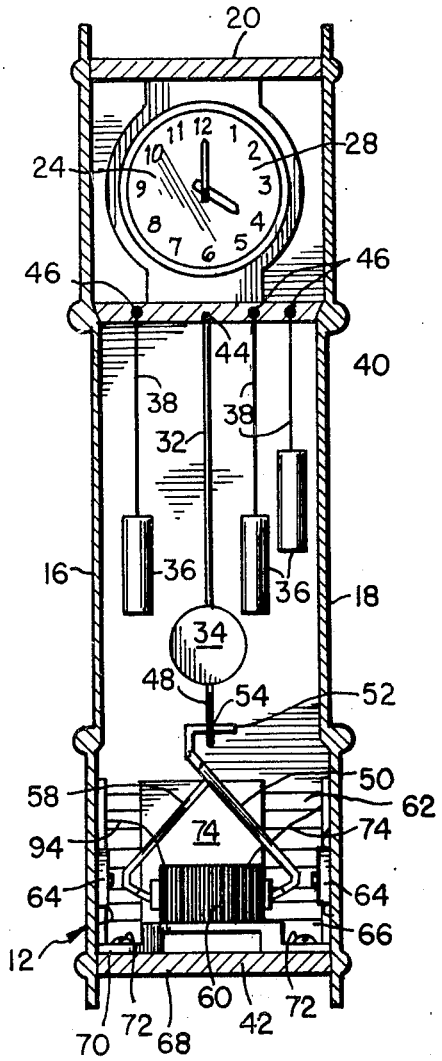
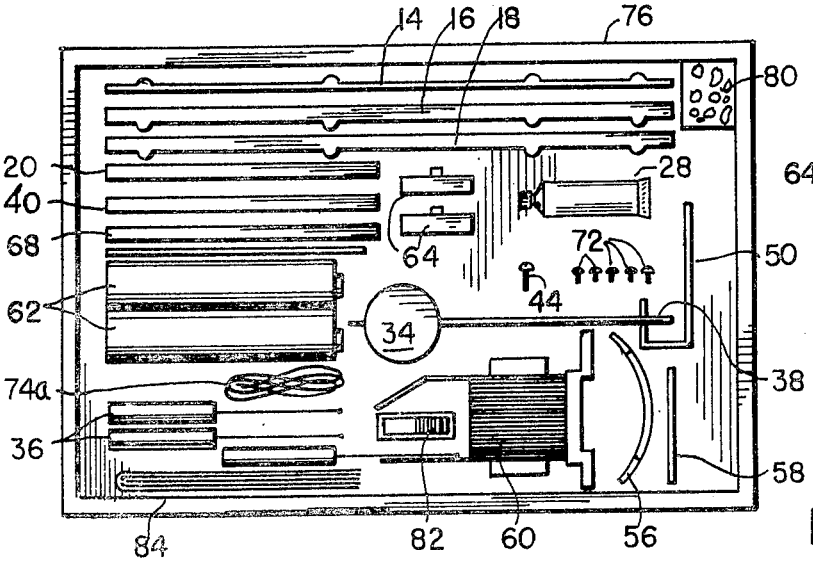
FIG. 3
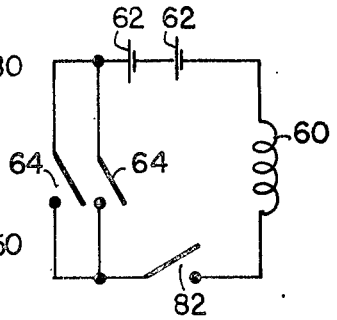
FIG. 4

MINIATURE GRANDFATHER CLOCK

BACKGROUND OF THE INVENTION

1. THE FIELD OF THE INVENTION

This invention pertains to clock housing and more particularly to that class of housing utilized to temporarily store wrist-watches whilst creating the effect that the housing is a miniature clock apparatus in of its own.

2. DESCRIPTION OF THE PRIOR ART

The prior art abounds with disclosures pertaining to actual "Grandfather Clocks" and their constructional features. The present invention totally differs from the prior art in that it simulates the appearance of an operating clock mechanism, by a pendulum, whilst in reality comprises an actual pendulum apparatus, operated by an electrical power source, to which there is no escapement or clock apparatus determining the rate of motion of the pendulum or utilizing the pendulum motion to operate the clock apparatus.

SUMMARY OF THE INVENTION

A primary object of the present invention is to provide a housing in which a wrist-watch may be removably stored such that the housing creates the impression of being in of itself an operating miniature "Grandfather Clock."

Another object of the present invention is to provide a housing which safely stores the wrist-watch such that the user may visibly see the wrist-watch dial when the watch is stored therewithin.

Still another object of the present invention is to provide a wrist-watch housing device which utilizes electric power to operate the pendulum apparatus thereof.

Yet another object of the present invention is to provide a pleasing apparatus whose sole function is to store a wrist-watch therein whilst appearing to be a functional clock device.

A further object of the present invention is to provide an economically manufactured housing device for wrist-watches which achieve the principal object apertaining thereto.

Heretofore, watch housings useful in the storage of wrist-watches, comprised housings which protected a delicate wrist-watch from damage when the watch was removed from the wrist of the user and desired to be stored. The present invention not only provides such utility but permits the user to view the face of the dial of the wrist-watch when the wrist-watch is in storage in the housing, and simultaneously provides the appearance of a functional "Grandfather Clock." This latter feeature is accomplished by a simulated pivotable pendulum electrically operated, utilizing a circuit which because of its unique design causes minimal amounts of current to flow from the battery supply in discrete bursts. Thus, the pendulum can continue to oscillate back and forth, whether or not the watch is stored within the housing for extended periods of time before requiring battery replacement. An opening is located in the housing which facilitates viewing of the dial of the wrist-watch when the wrist-watch is disposed on an interior shelf of the housing. Another opening is disposed located in the housing below the wrist-watch viewing opening such that portions of the pendulum may be viewed as the pendulum oscillates to and fro. Simulated weights are suspended downwardly behind the lower opening further simulating the functional portion of a "Grandfather Clock" apparatus. An electrical solenoid coil is operated intermittently by one or more momentary switches located on the interior wall of the housing. The switch or switches are urged into a closed circuited position only when portions of a curved bar, suspended from the lower regions of the pendulum, reach an extended range, out of vertical alignment, caused by a manual starting up of the pendulum oscillatory motion.

Thus, the present invention not only provides a safe and secure temporary housing for wrist-watches, but provides a pleasing container whose apparent functionalism as a "Grandfather Clock" is being emphasized by being able to view the dial portion of the wrist-watch when the wrist-watch is stored within the clock-like housing.

BRIEF DESCRIPTION OF THE DRAWINGS

FIG. 1 is a perspective view of the present invention, shown having a wrist-watch located therewithin.

FIG. 2 is a front elevation cross-sectional view taken through lines 2—2, viewed in the direction of arrows 2—2, of the apparatus shown in FIG. 1.

FIG. 3 illustrates a plan view of a container wherein the container houses the functional components of the apparatus depicted in FIG. 1, above the wrist-watch portion thereof.

FIG. 4 is a schematic diagram of the functional portions of the apparatus shown in FIG. 1 and 2.

DESCRIPTION OF THE PREFERRED EMBODIMENT

The present invention comprises an elongated rectangular housing, having five sides. Two of the sides comprises a front panel and a pair of side panels. Such panels are joined together by a uppermost panel, an interior shelf panel and a base panel. The front panel is adapted to have a first opening. A wrist-watch may be rested on the interior shelf such that the dial portion of the wrist-watch may be displaced in parallel alignment with the front panel and juxtaposed with the first opening, wherein the first opening is preferably circular in nature. Located below the first opening is a second opening, preferably of a rectangular nature. The second opening may be covered by a transparent sheet, such that the transparent sheet is fixedly secured to the front panel. A pendulum, comprising a shaft and a weight, has one end thereof pivotably secured to the interior shelf utilizing a pivot rod or axle therefor. The weight of the pendulum is disposed visibly accessible through the second opening and is free to operate in a plane parallel to the front panel but behind the second opening. One or more "weights," having the shape of solid rods, and having wire-like elements affixed to one end thereof are suspended downwardly from the interior shelf and are likewise visible from the second opening. The lowermost end of the pendulum is secured to a bar. The bar is disposed having an arcuate shape and is suspended downwardly from the lowermost end of the pendulum such that the lowermost end of the bar is centered about the longitudinal axis of the pendulum rod. The middle portion of the bar is fabricated from a magnetic material, such as steel. Disposed wrapped around the curved bar is an electric solenoid coil, such that the coil may be mounted to the base panel or plate of the housing. The opening in the solenoid coil is a sufficient size to permit the curved bar to operate within the solenoid coil. The curvature of the bar substantially defines a portion of the circumference of a circle having a radius extending from the pivot axle of the pendulum rod and extending radially outwardly therefrom to the surface of the curved bar. At least one, and preferably two switches are disposed mounted on the interior faces of the side panels of the housing. These switches are of the momentary variety and are normally open when their operating levers remain undepressed. These switches are located such that when the pendulum oscillates back and forth the end of the bars are free to engage their operating levers when the curved bar has reached a position displaced out of the vertical line extending vertically downwardly from the pivot axle. Thus, when either switch is operated by the adjacent end of the curved bar depressing its operating lever, the switch is momentarily closed urging a current flow from a battery power source, similarly housed within the housing, to flow through the solenoid coil, so as to induce a magnetic force acting on the middle magnetic regions of curved bar. This current flow, in pulse form, causes the pendulum, through the magnetic action on the curved bar, to be urged downwardly towards the rest position such that the longitudinal axis of the pendulum is aligned along the vertical line aforementioned. However, the momentum of the pendulum and the curved bar apparatus is such that the curved bar continues its arcuate path and moves towards the other side panel of the housing. When the other end of the curved bar engages the other momentary switch operating lever, a current flow is caused to be passed through the solenoid coil such that the pendulum reverses direction and continues arcuately downwardly at the curved bar end thereof towards the center rest position. This continued pulsing of current, acting on a curved bar, causes the pendulum and the curved bar to oscillate to and fro. The oscillatory motion of the pendulum creates the effect of an operable "Grandfather Clock" which, in reality, is non-existent except for the oscillatory motion of the pendulum, as viewed through the second opening, and for the operational motion of the hands of the wrist-watch, as viewed through the first opening.

The wrist-watch may be disposed in a secure location such that the face or dial portions thereof are aligned parallel with the front panel by utilizing a block of rubber-like foam material disposed within the housing between the top panel and the interior shelf panel.

A slide switch, of the single pole single flow variety, may be disposed in a fuse electrical circuit with the fuse electrical circuit comprising the terminals of the solenoid coil and the terminals of the battery and the terminals of the momentary switches, such that the momentary switches are in a parallel circuit arrangement with each other.

If desired, the present invention components, comprising the front panel, the pair of side panels, the base panel, the interior shelf and the top panel, the pendulum and pendulum rod, the weight and affixed wires, the solenoid coils, the curved bar and a wire-like apparatus used to affix the curved bar to the lowermost end of the pendulum, and a pivot rod or axle used to affix the pendulum to the interior shelf, the pair of momentary switches, the slide switch, the battery, fastening screws for securing the solenoid coil to the base panel and for securing the wires of the simulated weight to the housing, a tube of adhesive for assembly of the various components, and instruction sheets for assembly of the present invention may all be contained within the container such that the container may be assembled in a "do-it-yourself" kit for those users who enjoy assembling devices.

Now referring to the Figures, and more particularly to the apparatus illustrated in FIG. 1 showing the present invention 10 comprising a housing 12 having a front panel 14, a side panel 16 and a side panel 18. As shown an upper panel 20 joins the front panel and pair of side panels 16 and 18 together. A circular opening 22 is shown in front panel 14 having the dial 24 and hands 26 of a wrist-watch 28 located therebehind and visibly accessible therethrough. A second opening 30 is shown having a pendulum rod 32 which is provided with a pendulum weight 34. Cylindrical weights 36 are shown suspended from wire-like elements 38. Opening 30 may be covered by a glass-like transparent sheet, not shown, if desired.

FIG. 2 illustrates side panels 16 and 18 to which are affixed the uppermost panel 20 and interior shelf panel 40 and a base panel 42. Pendulum rod 32 is shown pivotably secured to interior shelf panel 40 utilizing pivot axle 44 therefor. Nail-like fasteners 46 are utilized to secure the upper end of wire-like elements 38 to interior shelf 40. A lowermost end 48 of pendulum rod 32 is shown having wire-like support 50 affixed thereto, by having end 52 of wire-like support 50 pass through opening 54 in end 48 of pivot rod 32. Curved bar 56 is shown suspended from wire-like form 50 and wire-like form 58, passing through solenoid coil 60. Electric dry cell batteries 62 are shown contained within housing 12, residing behind curved bar 56. Momentary switches 64 are shown mounted on the interior faces of side panels 16 and 18 such that their operating levers 66 may be engaged by the ends of curved bar 56 when curved bar 56 is disposed out of the central rest position. Solenoid coil 60 is shown fastened to base panel 68 by mounting plate 70 and mounting screws 72. Sheet 74 is utilized to maintain batteries 62 in a secure position but remote from the location of solenoid coil 60, curved bar 56 and wire-forms 50 and 58. Wrist-watch 28, is shown resting upon interior shelf 40 such that dial 24 thereof is disposed in a vertical plane, substantially normal to the planes in which side panels 16 and 18 reside. Wire 94 is shown interconnecting batteries 62, switches 64 and solenoid coil 60 in an electrical circuit, not shown.

FIG. 3 illustrates another version of the components shown in FIG. 1 and FIG. 2 when disassembled and in kit form, utilizing container 76 therefor. The container houses front panel 14, side panels 16 and 18, solenoid coil 60, curved bar 56, wire-forms 50 and 58, momentary switches 64, a tube of adhesive 78, a block of rubber-like sponge material 80, top panel 20, interior shelf 40, base panel 68, batteries 62, weight 36 and appended wire-like supporting elements therefor, a length of wire 74*a*, pendulum rod 38 and weight 34 thereof, fastening screws 70, pivot axle 44, slide switch 82, and instruction pamphlet 84. The slide switch may be disposed in electrical series circuit with switches 64, batteries 62, solenoid coil 60 and mounted in the position shown on FIG. 1, such that the pendulum weight 34 may be operable when desired or de-energized when the apparatus is not in use.

FIG. 4 illustrates solenoid coil 60, batteries 62, momentary switches 64, and slide switch 82 all disposed in a series electrical circuit, excepting both momentary switches 64, each disposed parallel to each other and in series with the remaining electrical components. When switch 82 is maintained in an open circuit condition, batteries 62 will not energize solenoid coil 60 regardless of the operable electrical condition of switches 64. However, when switch 82 is closed, current is available from batteries 62 to momentarily energize solenoid coil 60 upon the temporary closing of either switch 64.

One of the advantages of the present invention is a housing in which a wrist-watch may be removably stored such that the housing creates the impression of being in of itself an operating miniature "Grandfather Clock."

Another advantage of the present invention is a housing which safely stores the wrist-watch such that the user may visibly see the wrist-watch dial when the watch is stored therewithin.

Still another advantage of the present invention is a wrist-watch housing device which utilizes electric power to operate the pendulum apparatus thereof.

Yet another advantage of the present invention is a pleasing apparatus whose sole function is to store a wrist-watch therein whilst appearing to be a functional clock device.

A further advantage of the present invention is an economically manufactured housing device for wrist-watches which achieve the principal object apertaining thereto.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. A simulated clock apparatus comprising a housing, said housing having a first and second opening therein, said first opening located above said second opening, said housing having an interior shelf, said interior shelf being disposed intermediate said first opening and said second opening, a pendulum, said pendulum being pivotably secured at one end thereof to said housing, a solenoid coil, said solenoid coil having an opening passing therethrough, a bar, a portion of said bar being fabricated from a steel material, said portion of said bar located intermediate the ends of said bar, said bar having an arcuate shape, said bar being disposed passing through the opening in said solenoid coil, means to secure at least one end of said bar to the other end of said pendulum, means to secure said solenoid coil to said housing, at least a portion of said pendulum being visible through said second opening, at least one battery, said at least one battery being coupled to said solenoid coil, at first switch, said first switch being coupled to said battery and said solenoid coil, said first switch and said at least one battery and said solenoid coil being disposed in a series electrical circuit, said first switch being disposed in a closed circuited condition upon said pendulum being displaced angularly away from the vertical position and when one end of said bar is in touching engagement with an operating lever of said first switch, means to mount a wrist-watch on said interior shelf such that the dial of said wrist-watch is visible through said first opening, a second switch, said second switch being disposed in parallel electrical relationship with said first switch, said second switch and said first switch being fixedly secured to opposed surfaces of said housing wherein the ends of said bar alternately and selectively engage said actuating lever of said first switch and the actuating lever of said second switch as said bar is angularly displaced about a vertical line, and wherein said solenoid coil is periodically de-energized each time said ends of said bar is disengaged from said actuating levers of said first and said second switches and is disposed located thereinbetween.

2. The simulated clock apparatus as claimed in claim 1 further comprising at least one simulated weight, said one simulated weight fixedly secured to one end of a wire, the other end of the wire being disposed secured to said interior shelf.

3. The simulated clock apparatus as claimed in claim 1 further comprising a single pole single throw slide switch, said slide switch being coupled in a series circuit with said series circuit, said slide switch being disposed fixedly secured to said housing.

4. The simulated clock apparatus as claimed in claim 1 wherein said housing further comprises a transparent sheet, said transparent sheet being disposed fixedly secured to said housing and covering said second opening.

5. The simulated clock apparatus as claimed in claim 1 further comprising said housing having an elongated opening, said elongated opening being disposed in opposed parallel relationship with a portion of said housing having said first opening and said second opening thereon.

* * * * *